US005651273A

United States Patent [19]

Levy

[11] Patent Number: 5,651,273

[45] Date of Patent: Jul. 29, 1997

[54] HINGED FINGER RING

[75] Inventor: Davida Levy, Surfside, Fla.

[73] Assignee: Davida Enterprises, Inc., Miami, Fla.

[21] Appl. No.: 729,097

[22] Filed: Oct. 11, 1996

Related U.S. Application Data

[63] Continuation of Ser. No. 467,204, Jun. 7, 1995, abandoned, which is a continuation-in-part of Ser. No. 83,228, Jun. 29, 1993, abandoned.

[51] Int. Cl.[6] ..... A44C 9/00

[52] U.S. Cl. ..... 63/15.7

[58] Field of Search ..... 63/15, 15.7; 24/616

[56] References Cited

U.S. PATENT DOCUMENTS

| | | | |
|---|---|---|---|
| 145,788 | 12/1873 | Cottle . | |
| 147,078 | 2/1874 | Stone . | |
| 393,222 | 11/1888 | Elleau | 24/616 |
| 744,605 | 11/1903 | Pizor . | |
| 856,480 | 6/1907 | Long | 24/616 |
| 1,003,696 | 9/1911 | Briggs | 63/15.7 X |
| 1,152,340 | 8/1915 | Obsboum . | |
| 1,182,254 | 5/1916 | Cummins . | |
| 1,193,330 | 8/1916 | Wray | 24/616 |
| 1,409,138 | 3/1922 | Fontana . | |
| 1,807,293 | 5/1931 | Keller . | |
| 2,178,572 | 11/1939 | Forstner . | |
| 2,654,929 | 10/1953 | Feibelman . | |
| 2,771,753 | 11/1956 | Sallan . | |
| 3,263,444 | 8/1966 | Di Croce . | |
| 3,566,616 | 3/1971 | Benedict . | |
| 3,619,913 | 11/1971 | Albrecht . | |
| 4,426,854 | 1/1984 | Geldwerth et al. . | |
| 4,543,692 | 10/1985 | Ode et al. . | |
| 4,745,667 | 5/1988 | Conte . | |
| 4,763,490 | 8/1988 | Bruner . | |
| 4,790,148 | 12/1988 | Faini . | |
| 4,815,180 | 3/1989 | Elsener . | |
| 4,991,409 | 2/1991 | Creates . | |
| 5,008,984 | 4/1991 | Levy . | |
| 5,050,276 | 9/1991 | Pemberton . | |
| 5,092,019 | 3/1992 | Levy . | |
| 5,136,858 | 8/1992 | Bruner . | |
| 5,197,168 | 3/1993 | Levy . | |
| 5,231,740 | 8/1993 | Mohebkhosravi | 24/616 |
| 5,272,795 | 12/1993 | Rothstein | 24/616 |

FOREIGN PATENT DOCUMENTS

| | | |
|---|---|---|
| 910002 | 5/1946 | France . |

*Primary Examiner*—Joanne Silbermann
*Attorney, Agent, or Firm*—Keck, Mahin & Cate

[57] ABSTRACT

A hinged finger ring which is adapted to fit around the base of a finger without slipping is particularly useful for wearing on a finger having an enlarged knuckle. The ring preferably includes ornamented portions attached to first and second shank portions which are hinged together at ends opposite from the ornamented portions. The ring is closed around the finger by latching a male member attached to one of the ornamented portions into a cavity in the other of the ornamented portions. The latch is released to remove the ring by pressing down on the ornamented portion to which the male member is attached, thereby releasing the latch and allowing the ring to be opened.

5 Claims, 1 Drawing Sheet

HINGED FINGER RING

RELATED APPLICATIONS

This is a continuation application of Ser. No. 08/467,204, filed on Jun. 7, 1995, now abandoned, which is a continuation-in-part of Ser. No. 08/083,228, filed on Jun. 29, 1993, now abandoned.

FIELD OF THE INVENTION

The invention relates to jewelry, particularly rings for a finger, the rings being hinged to allow a ring to fit a base of a finger without slipping.

BACKGROUND OF THE INVENTION

Known hinged rings have closures which are not simple to use for persons having swollen finger joints or arthritic fingers. U.S. Pat. No. 3,263,444, to Di Croce, describes a hinged ring having mechanical closures in FIGS. 1 and 2. U.S. Pat. Nos. 3,566,616; 4,763,490; 4,790,148; 4,991,409; and 5,136,858 each show hinged rings having mechanical closures which are relatively complex and/or expensive to make.

SUMMARY OF THE INVENTION

A hinged finger ring is particularly useful for wearing on a finger having an enlarged finger joint, so that the ring fits around the base of the finger without slipping. The ring includes ornamented portions attached to first and second shank portions which are hinged together at ends opposite from the ornamented portions. The ring is closed around the finger by securing a male member attached to one of the ornamented portions into a cavity in the other of the ornamented portions. The catch is released to remove the ring by pressing down on the ornamented portion to which the male member is attached, thereby releasing the catch and allowing the ring to be opened.

An object of the invention is to provide a hinged finger ring having a secure clasp.

Another object of the invention is to provide a hinged finger ring which fits around a base of a finger without slipping even if the finger joints are enlarged.

DETAILED DESCRIPTION OF THE PREFERRED EMBODIMENTS

Figure 1:
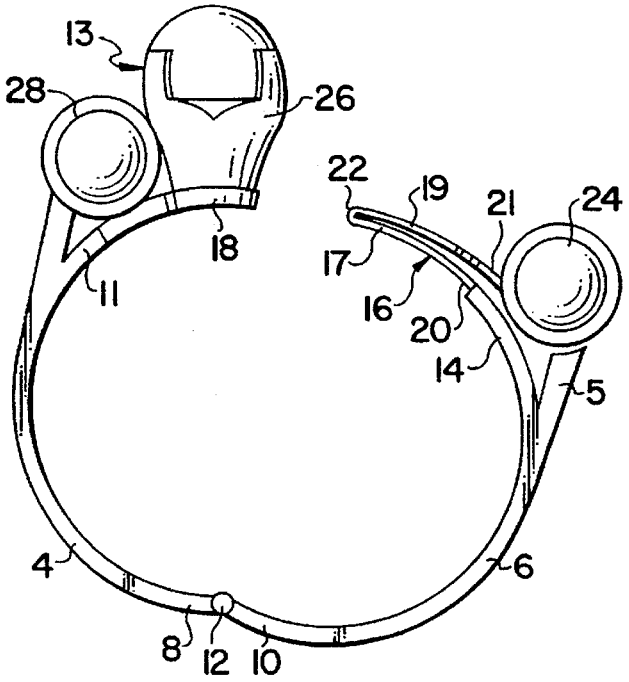
FIG. 1 is a side view of a hinged finger ring of the invention, in open position.

With reference to FIGS. 1 to 5, in which like numerals represent like parts, FIG. 1 illustrates a hinged ring of the invention in open position. The ornamentation shown is a non-limiting example. Any appropriate ornamentation may be used. Ring 2 has a first shank portion 4 and a second shank portion 6. A first end 8 of the first shank portion 4 is hinged to a first end 10 of the second shank portion 6 at hinge 12.

The second end 11 of the first shank portion 4 terminates in a first ornamented portion 13 of the ring 2. The second end 14 of the second shank portion 6 terminates in a male member 16 which is receivable in a cavity 18 at the base of the first ornamented portion 13 of the first shank portion 4. Male member 16 forms a spring member which includes a lower spring member 17 and an upper spring member 19 which are joined together at their distal ends at bend 22. The proximal end 20 of lower spring member 17 of male member 16, which is the proximal end of male member 16, is joined to the second end 14 of the second shank portion 6. The proximal end 21 of upper spring member 19, which is the distal end of male member 16, is joined to an ornamented portion 24 of the ring 2 which is adjacent but not attached to end 5 of second shank portion 6.

Figure 2:
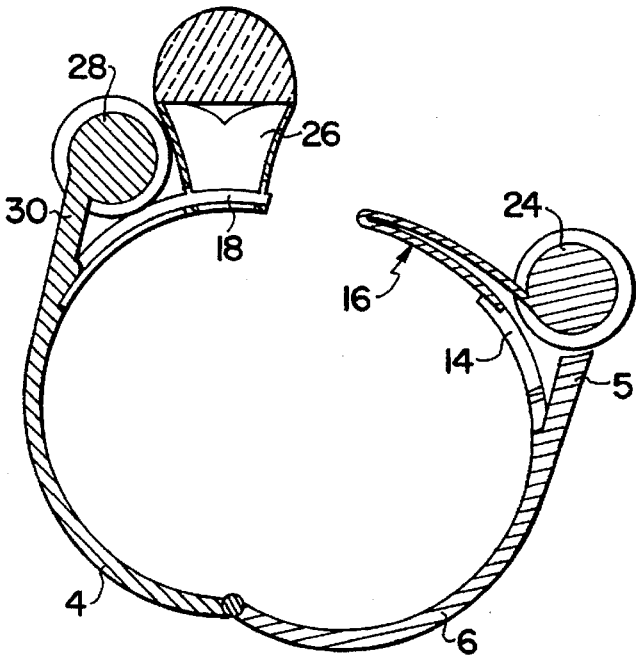
FIG. 2 is a cross-sectional view of the ring of FIG. 1, in open position.

FIG. 2 is a cross-sectional view, showing the ring 2 in open position. It can clearly be seen that ornamented portion 24 is spaced from end 5 of second shank portion 6, to allow ornamented portion 24 to be pressed down for inserting into cavity 18 and to be released when the ring is in closed position. Ornamental portions 26 and 28 are adjacent each other and ornamental portion 28, which may be the same as or different from ornamental portion 24, is attached to end 30 of first shank portion 4, which is hinged to second shank portion 6.

Figure 3:
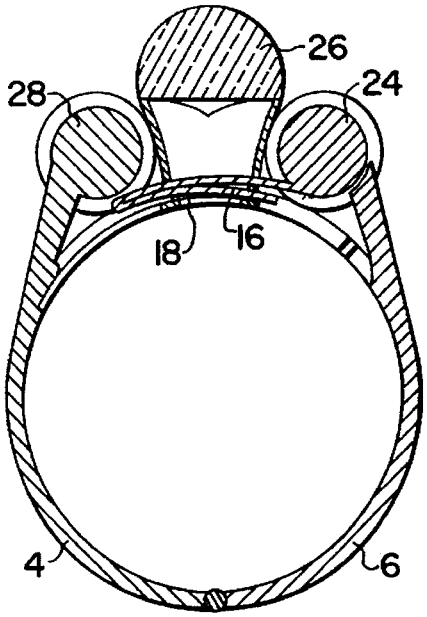
FIG. 3 is a cross-sectional view of the ring of FIG. 1, in closed position.

FIG. 3 shows the ring of FIG. 2 in closed position with male member 16 inserted into cavity 18. The opening 33 of cavity 18 in the side of ornamented portion 26 is shown in detail in FIG. 4.

Figure 4:
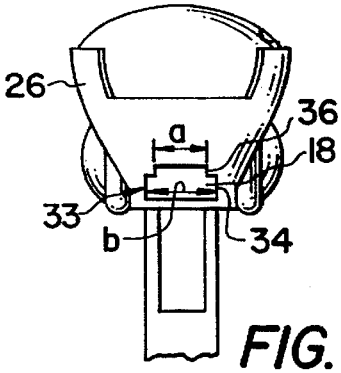
FIG. 4 is an end elevational view of a first shank portion of the ring, in open position, showing the opening of the cavity for receiving the male member of the second shank portion.

To open the ring from closed position, ornamented portion 24 is pressed down to release male member 16 from the opening 33 of the cavity 18 shown in FIG. 4. To close the ring from open position, male member 16 is fully inserted into cavity 18 so that notches 32 are secured in the catch formed by opening 33 of cavity 18 shown in FIG. 4.

Figure 5:
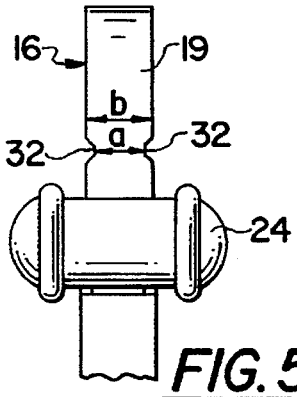
FIG. 5 is a top plan view of a male member of a second shank portion of the ring, in open position.

FIGS. 4 and 5 illustrate details of the shape of the opening 33 of cavity 18 which forms part of the catch for the ring and the complementary notches 32 in the male member 16 which secure the ring in closed position. As shown in FIG. 5, upper portion 19 of male member 16 has opposing notches 32 cut out from the width of male member 16, separated by a distance "a" between them. The width of upper portion 19 is "b", which is substantially "a" plus the amounts cut out from upper portion 19 for the two notches 32. FIG. 4 shows opening 33 of cavity 18 into which male member 16 is inserted. The outer face or opening 33 of cavity 18 is located in the ornamented portion 26 and is shaped as an inverted "T". A lower portion thereof 34 has a width just sufficiently wider than width "b" for the male member 16 to be readily inserted. When fully inserted to the position where male member 16 is inserted up to notches 32, and pressure on ornamented portion 24 is released, upper member 20 springs upward to engage in the upper portion 36 of the face of the inverted "T" shaped opening 33 of cavity 18 which has a width "a" that is less than width "b". Upper portion 36 engages upper portion 19 of male member 16 at notches 32. To release the catch, ornamented portion 24 is pressed downward, releasing notched portion 32 from "a" and allowing male member 16 to be removed from cavity 18, thus allowing the ring to be opened by separating the two hinged parts.

It is preferable that the catch be concealed by part of the ornamentation, as illustrated, so that pressure on the ornament releases the catch allowing the ring to be opened. The ornamented parts illustrated are not in any way limiting.

The rings may be made of metal such as gold, silver or base metal, or a combination of metals, and the ornamented portions may be jeweled or otherwise as known in the art.

While the invention has been described above with respect to certain embodiments thereof, variations and modifications may be made without departing from the spirit and scope of the invention.

What is claimed is:

1. A hinged finger ring comprising:

means for fitting the ring closely around a finger, comprising:

shank means having a first arcuate shank portion and a second arcuate shank portion hinged together at first ends thereof, sized for fitting together closely around a finger;

ornamentation on said shank means comprising a first ornamented portion disposed on a second end of said first shank portion and a second ornamented portion disposed on a distal end of a V-shaped male member having its proximal end attached to a second end of said second shank portion, said first ornamented portion and said second ornamented portion together forming the ornamentation when the hinged ring is in closed position; and means for opening the hinged finger ring and for closing the hinged finger ring closely around a finger, wherein said first ornamented portion comprises a cavity disposed within a lower part thereof for receiving said male member, wherein said male member is secured in said cavity in said first ornamented portion when said hinged finger ring is in said closed position, and free from said cavity in said first ornamented portion when said hinged finger ring is in an open position, and wherein said male member is released from a secured position in said cavity by applying pressure to said second ornamented portion, wherein said second ornamented portion on said distal end of said V-shaped spring member is moved toward and adjacent said proximal end of said V-shaped spring member, thereby releasing said male member from said secured position while said male member is still aligned within said cavity, thereby enabling said first and second shank portions to be separated from each other by withdrawing said male member from said cavity;

wherein said male member comprises a spring member having opposing notches therein for receiving in a catch in said first ornamented portion.

2. A hinged finger ring according to claim 1, wherein said cavity is disposed in a lower portion of said first ornamented portion.

3. A hinged finger ring according to claim 1, wherein said first ornamented portion comprises a central portion and a side portion adjoining the central portion and said cavity is disposed in said central portion, wherein said male member is adapted to enter the cavity through said central portion and to be secured therein when said hinged finger ring is closed.

4. A hinged finger ring according to claim 3, wherein said cavity is disposed in both said central portion and said side portion and said male member is adapted to enter said cavity of both said central portion and said side portion and to be secured therein when said hinged finger ring is closed.

5. A hinged finger ring according to claim 1 wherein said catch comprises a face of said cavity in which an opening is shaped as an inverted "T" and said notches are held by an upper portion thereof.

* * * * *